US005094565A

United States Patent [19]

Johnson

[11] Patent Number: 5,094,565

[45] Date of Patent: Mar. 10, 1992

[54] MULTI-HEAD CUTTING TOOL AND METHOD FOR ITS USE

[75] Inventor: Henry M. Johnson, Loysville, Pa.

[73] Assignee: Surface Preparation Technologies, Inc., Mechanicsburg, Pa.

[21] Appl. No.: 621,986

[22] Filed: Dec. 4, 1990

[51] Int. Cl.[5] ..... E01C 23/08; E01C 23/12; E21C 47/00

[52] U.S. Cl. ..... 404/75; 404/90; 299/39

[58] Field of Search ..... 404/75, 90, 93; 299/39, 299/37; 125/13.01, 13.02, 14, 15, 20

[56] References Cited

U.S. PATENT DOCUMENTS

| | | | |
|---|---|---|---|
| 2,403,078 | 7/1946 | Hettelsater | 299/39 |
| 2,855,189 | 10/1958 | Lewis | 299/39 |
| 3,007,688 | 11/1961 | Hatcher | 299/39 |
| 3,896,989 | 7/1975 | Ellis | 299/39 |
| 3,902,760 | 9/1975 | Ellis | 299/39 |
| 4,236,356 | 12/1980 | Ward | 125/13.01 X |
| 4,588,231 | 5/1986 | Silay et al. | 299/39 |
| 4,714,374 | 12/1987 | Mihara | 299/39 X |
| 4,717,205 | 1/1988 | Sasage | 404/90 X |
| 4,900,094 | 2/1990 | Sergeant | 404/94 X |

*Primary Examiner*—Ramon S. Britts
*Assistant Examiner*—Nancy P. Connolly
*Attorney, Agent, or Firm*—Foley & Lardner

[57] ABSTRACT

A cutting tool for cutting depressions in the shoulder or along the center line of a roadway comprises a plurality of rotatable cutting heads which are aligned generally in parallel with one another and which are fixedly connected to one another and to drive means for rotating the cutting heads. Each of the cutting heads may be rotatably mounted within a respective drum housing. First and second ones of the drum housings are rigidly connected to one another via a rigid connecting member to form a first cutting head set, and third and fourth ones of the drum housings are rigidly connected to one another to form a second cutting head such that the first and second cutting head sets is self-aligning. A least one of the cutting members is driven to rotate in a direction opposite from that of the other cutting members to prevent the cutting heads from pulling the cutting tools down the roadway.

13 Claims, 3 Drawing Sheets

MULTI-HEAD CUTTING TOOL AND METHOD FOR ITS USE

BACKGROUND OF THE INVENTION

1. Field of the Invention

This invention relates to a cutting tool for cutting a series of depressions along the shoulder of roadways and more particularly to a cutting tool which can be attached to a multipurpose power unit such as a skid steer loader.

2. Brief Description of the Prior Art

There has always been concern that when a person is driving a car it is often very easy to drift off the road or over the center line and into the opposite lane of traffic, which can potentially lead to disastrous results. Therefore, a series of depressions are often cut along the shoulder or center line of the road and are referred to as a sonic noise alert pattern (SNAP). The purpose of the SNAP pattern is to alert drivers when drifting off creating a sound or vibration as the vehicle's tires travel over the depressions.

Currently, there is known in the art a cutting tool with a single milling head used to cut individual depressions. The milling head is attached to a multi-purpose power unit such as a skid steer loader. The multipurpose power unit operator lowers the milling head to the road's surface to cut a single depression. The milling head is raised, moved and lowered at the next position for cutting the subsequent depression. This procedure is very time consuming resulting in excessive operator labor hours and increased SNAP production costs. What the present art currently lacks is a cutting tool which can cut simultaneously a series of depressions, thereby increasing the production rate for making SNAP depressions in the shoulder or along the center line of a road.

SUMMARY OF THE INVENTION

An objective of the invention is to provide a multi-head cutting tool which has a plurality of milling heads and which is capable of being lowered to a road surface for simultaneously cutting a series of SNAP depressions.

Another object of the invention is to provide a series of milling head sets, whereby each milling head set comprises a plurality of milling heads connected to each other so that each set can be self-aligned with the road's surface.

In accordance with a first aspect of the invention, the cutting tool comprises a plurality of rotatable cutting heads which are aligned generally in parallel with one another and which are connected to one another, and drive means for driving the cutting heads to rotate. Each of the cutting heads may be rotatably mounted within a respective drum housing. First and second ones of the drum housings are rigidly connected to one another via a rigid connecting member to form a first cutting head set, and third and fourth ones of the drum housings are rigidly connected to one another to form a second cutting head set such that the first and second cutting head sets are self-aligning.

Another object of the invention is to provide a multi-head cutting apparatus which provides greater consistency in properly aligning the individual depressions in a SNAP.

In accordance with another aspect of the invention, the drive means may comprise a first gearbox which is adapted to receive an input torque and to generate an output torque, second and third gear boxes which are adapted to receive the output torque from the first gearbox as an input torque and to generate a respective output torque, and means for transmitting the output torques from the first and second gearboxes to the first and second cutting head sets, respectively. The output torques of the second and third gearboxes are generated by way of first and second respective shafts which rotate in opposite directions, and the means for transmitting torque comprises a first set of belts which connect the shaft of the second gearbox to the first set of cutting heads and a second set of belts which connect the shaft of the second gearbox to the second set of cutting heads.

Another object of the invention is to provide a method of cutting depressions in the shoulder or along the center line of the road. The first aspect of method comprises the steps of positioning a cutting tool above the shoulder, the cutting tool comprising at least two cutting heads which are arranged in parallel with one another and which are connected to one another. Subsequent steps include lowering the cutting heads onto the shoulder, then rotating the cutting heads to cut the depressions in the shoulder, and then raising the cutting heads.

A second aspect of the method concepts of the invention comprises the further steps of moving the cutting tool ahead following the step of raising the tool, then positioning the first cutting head between depressions formed between first and second cutting heads, and then repeating the steps of lowering the tool, cutting the depressions, and then raising the tool.

In accordance with yet another aspect of the methodology of the invention, the step of rotating the cutting head comprises the step of rotating the first and second cutting heads in a direction which is opposite to the direction of rotation of the third and fourth cutting heads.

Other objects, features and advantages of the present invention will become apparent to those skilled in the art from the following detailed description. It should be understood, however, that the detailed description and specific examples, while indicating preferred embodiments of the present invention, are given by way of illustration and not limitation. Many changes and modifications within the scope of the present invention may be made without departing from the spirit thereof, and the invention includes all such modifications.

BRIEF DESCRIPTION OF THE DRAWINGS

Other objects, features and advantages of the present invention will become apparent from the following detailed description and accompanying drawings wherein.

DETAILED DESCRIPTION OF THE PREFERRED EMBODIMENTS

Figure 1:
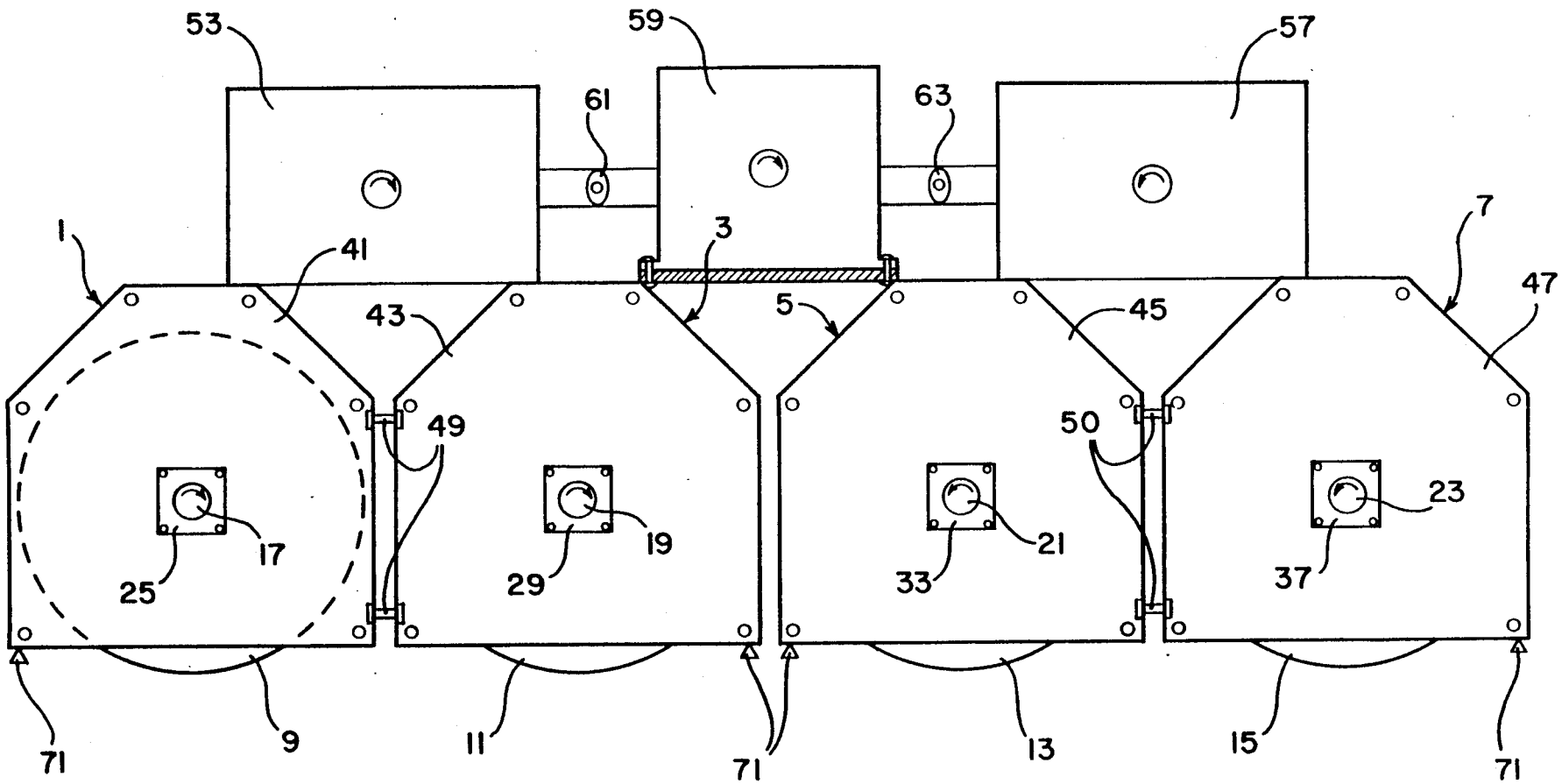
FIG. 1 is a right-side view of a multi-head cutting machine.
Figure 2:
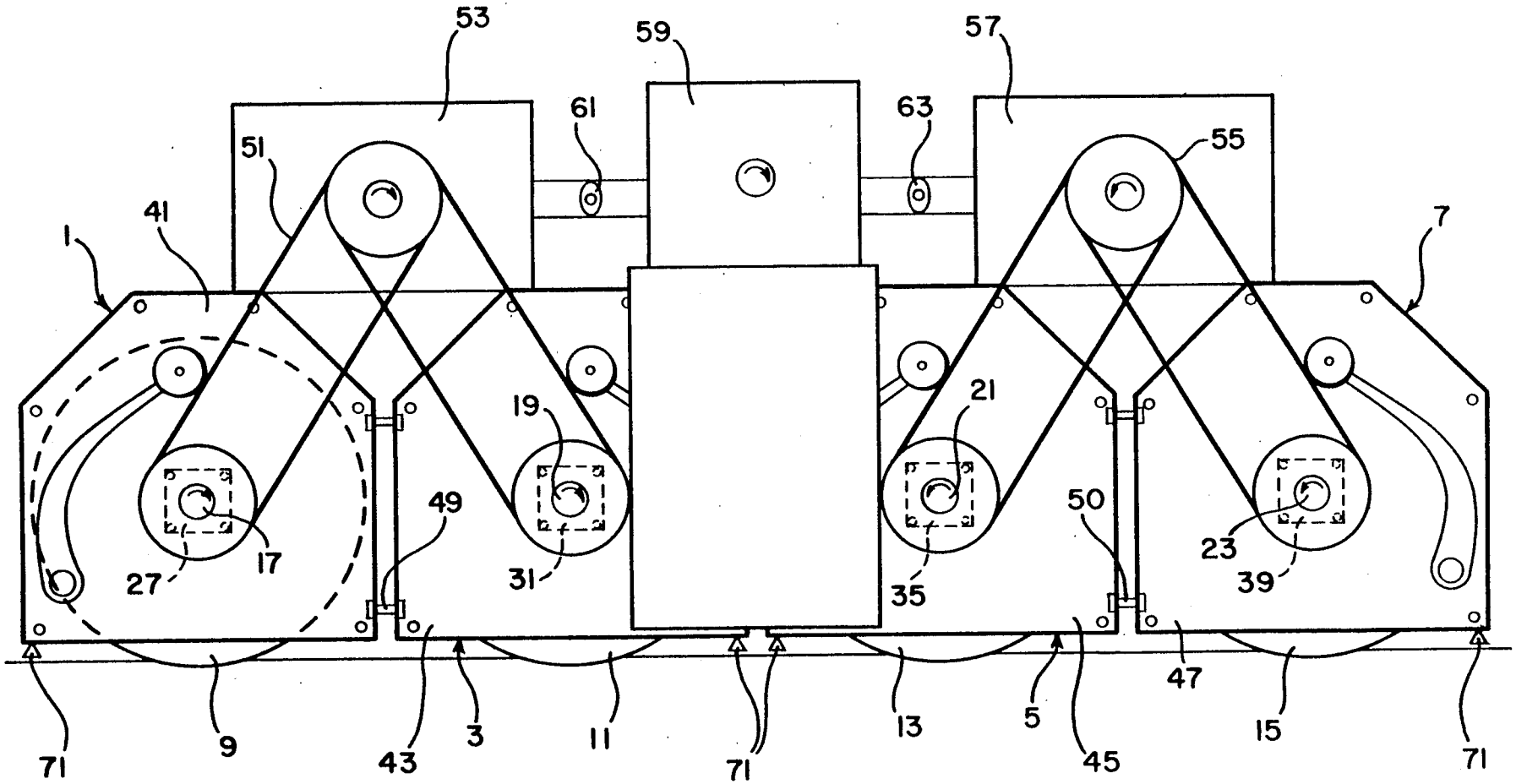
FIG. 2 is a left-side view of a multi-head cutting machine.
Figure 3:
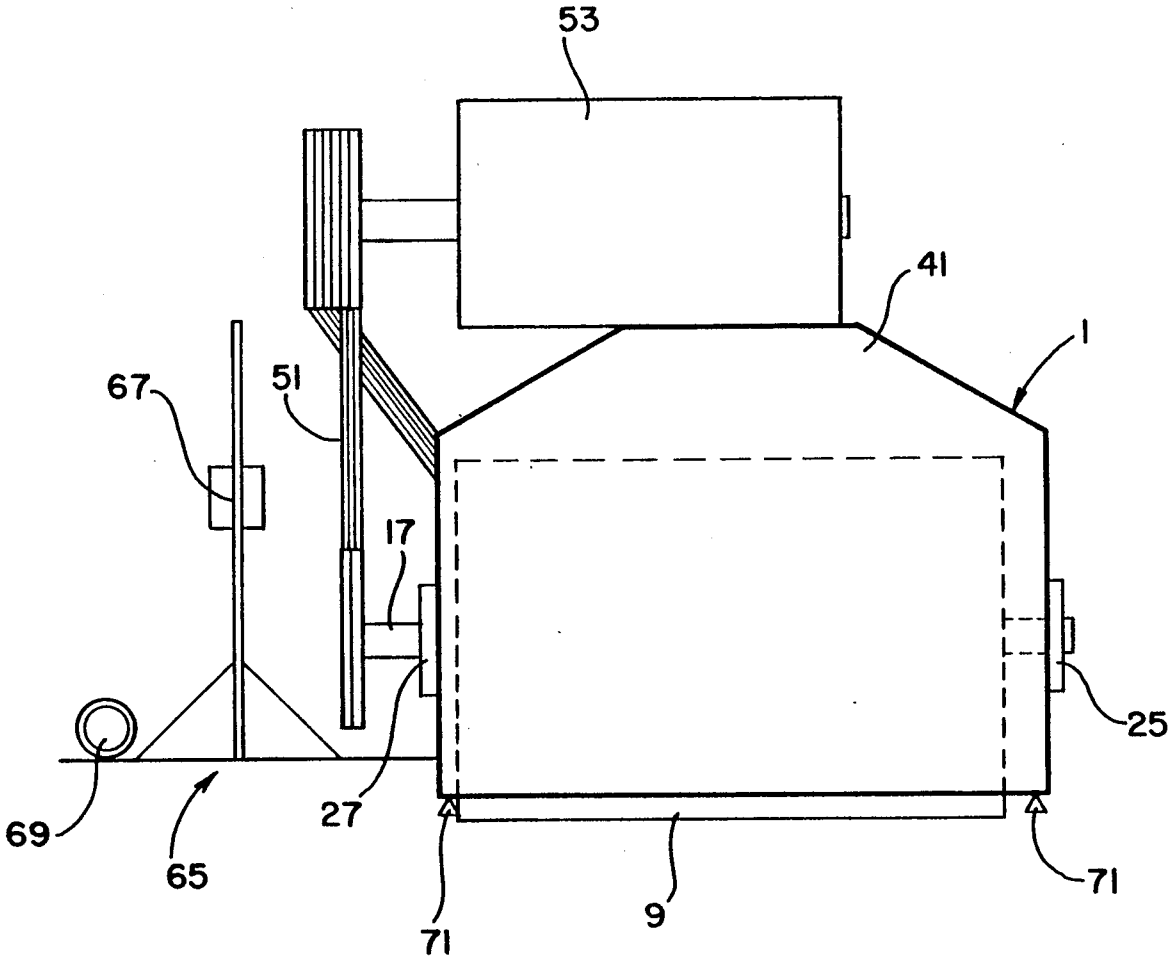
FIG. 3 is an end view of a multi-head cutting machine connected to a multi-purpose power unit.

Referring to FIGS. 1–3, a cutting tool includes four conventional milling heads 1, 3, 5, 7 mounted on a single unit. Each milling head 1, 3, 5, 7 has a circular cutting drum 9, 11, 13, 15, respectively, which drums are supported by shafts 7, 19, 21 and 23, respectively. Each shaft 17, 19, 21, 23 is supported by two bearings 25 and 27, 29 and 31, 33 and 35, 37 and 39, respectively. Bearings 25 and 27, 29 and 31, 33 and 35, and 37 and 39 are in turn supported by drum housings 41, 43, 45, 47, respectively. Drum housings 41 and 43 are connected to one another by rigid connectors 49 to form a first cutting head set, and drum housings 45 and 47 are similarly connected by rigid connectors 50 to form a second cutting head set. The separation of the tool into distinct head sets allows each set to self-align with the surface of the road during the cutting process, thereby providing a more uniform cut.

The cutting drums 9, are driven in a conventionally-known manner by belts 51 and a gear box 53 which is mounted above milling heads 1 and 3. Similarly, cutting drums 13, 15 are driven by belts 55 and gear box 57 which is mounted above milling heads 5 and 7. Gear boxes 53, 57 are coupled to a central gear box 59 via universal joints 61 and 63, respectively. In the preferred embodiment, the respective output shafts of gear boxes 53 and 57 are rotated in opposite directions so that cutting drums 13, 15 are driven to rotate in an opposite direction from drums 9, !1. This counter-rotating feature prevents the cutting tool from "crawling" down the roadside as it would otherwise have a tendency to do if all of the cutting heads were rotating in the same direction. While this counter-rotating feature prevents the cutting heads from driving the tool down the road, any other method of preventing this—such as increasing the load above the cutting heads—could also be used.

Gear box 59 receives its power from a remote power unit 65 such as a skid steer loader, shown diagrammatically in FIG. 3. Milling heads 1, 3, 5, 7 are mounted to power unit 65, while gear box 59 is mounted independently from milling heads 1, 3, 5, 7 to power unit 65. Power unit 65 is equipped with a conventional device for lowering and raising the milling heads 1, 3, 5, 7 so that they can come in contact with the road surface.

FIG. 3 illustrates a diagrammatic representation of a conventional single swivel point 67 and a conventional up-an-down swivel point 69 which are connected to the power unit 65 and to a single milling head set 3. A corresponding swivel arrangement (not shown) is independently connected to the second milling head set 5, 7. The side-to-side swivel point 67 and the up-and-down swivel point 69, allow the connected milling head sets 1, 3 and 5, 7, acting as individual sets, to independently swivel in four directions and to self-align with inconsistencies in the road surface when the tool is lowered. Additionally, conventional adjustable levelling mounts 71 are provided at the corners of each drum housing 41, 43, 45, 47 for adjustably positioning the housings, and thus the cutting drums, from the road surface. The device for raising and lowering milling heads 1, 3, 5, 7 is conventionally known in the current art.

In the preferred embodiment of the invention, each cutting drum 9, 11, 13, 15 will be 22 inches in diameter and 16 inches in width and spaced apart by 2 feet from center to center. However, it is clear that the size and spacing of the cutting drums can be varied to accommodate various depression/SNAP requirements.

Furthermore, while the illustrated embodiment employs a single drive device coupled to a direct-drive system utilizing belts to drive the cutting drums, other direct or indirect drive systems such as a hydraulic drive system could be used in its place. Additionally, the number of gear boxes, cutting heads, and drive systems employed can be readily varied as desired.

In operation, the operator first orients the tool so that the heads are suspended above the shoulder of the road and face the edge of the road or the center line of the road, as the case may be. The operator then activates a device which rotates the drums and lowers the milling head sets 1, 3 and 5, 7 into contact with the road surface. Each set 1, 3 and 5, 7 then self-aligns with the road surface as the weight of the cutting drums 9, 11, 13, 15 allows them to cut down to a predetermined depth. Once the initial four cuts are made, the operator raises the multihead cutting apparatus, advances it 12 inches ahead, and re-lowers it, thereby cutting four additional depressions between the preceding four depressions. The resulting SNAP pattern has eight depressions spaced twelve inches apart. The operator will then typically move the multipurpose cutting apparatus 7 feet ahead and repeat the above procedure.

As can be seen in this embodiment, the production rate for making depressions is improved by a factor of 4. This is because four depressions are made at one time, versus the conventional single milling head apparatus.

While a single embodiment of the invention has been described, it will be understood that it is capable of still further modifications, and this application is intended to cover any variations, uses, or adaptations of the invention, following in general the principles of the invention and including such departures from the present disclosure as to come with the knowledge of customary practice in the art to which the invention pertains, and as may be applied to the essential features hereinbefore set forth and falling within the scope of the invention or the limits of the appended claims.

What is claimed is:

1. A multi-head cutting tool, comprising:

at least first and second rotatable cutting heads aligned generally in parallel with one another;

drive means for driving said cutting heads to rotate;

means for lowering and raising said cutting heads to position the same for engagement and disengagement with a road surface, whereby said cutting heads are lowered into engagement with a road surface to cut first depressions and are raised to cause disengagement and to permit further depressions to be cut;

means for transversely moving said cutting heads in the direction of their alignment, whereby subsequent to being lowered and raised, said cutting heads can be transversely moved and subsequently relowered to engage the road surface, thereby cutting said further depressions between and to the other side of said first depressions.

2. The multi-head cutting tool of claim 1, wherein said drive means is adapted to rotate at least said first and second cutting heads in opposite directions.

3. The multi-head cutting tool of claim 1, further comprising a plurality of drum housings, wherein each of said cutting heads is rotatably mounted within a respective one of said drum housings, and wherein first and second ones of said drum housings are connected to one another to form a cutting head set, and further comprising means for variably levelling said cutting head sets to adjust for road surface inconsistencies.

4. A multi-head cutting tool, comprising:

a plurality of rotatable cutting heads which are aligned generally in parallel with one another;

drive means for driving said cutting heads to rotate;

a plurality of drum housings wherein each of said cutting heads is rotatably mounted within a respective one of said drum housings, and wherein said first and second ones of said drum housings are rigidly connected to one another to form a first cutting head set, and said third and fourth ones of said drum housings are rigidly connected to one another to form a second cutting head set;

means for independently aligning each of said first and second cutting head sets to compensate for inconsistencies in a road surface to be cut;

mean for lowering and raising said cutting heads to position the same for engagement and disengagement with a road surface, whereby said cutting heads are lowered into engagement with a road surface to cut first depressions and are raised to cause disengagement and to permit further depressions to be cut;

means for transversely moving said cutting heads in the direction of their alignment, whereby subsequent to being lowered and raised, said cutting heads can be transversely moved and subsequently relowered to engage the road surface, thereby cutting said further depressions between and to the other side of said first depressions.

5. The multi-head cutting tool of claim 4, wherein said drive means comprises a first gearbox which is adapted to receive an input torque and to generate an output torque, second and third gear boxes which are adapted to receive said output torque from said first gearbox as an input torque and to generate a respective output torque, and means for transmitting the output torques from said second and third gearboxes to said first and second cutting head sets, respectively; and wherein said output torques of said second and third gearboxes are generated by way of respective shafts which rotate in opposite directions, and wherein said means for transmitting comprises a first set of belts which connect the shaft of said second gearbox to said first set of cutting heads to rotate said first set of cutting heads in a first direction, and a second set of belts which connect the shaft of said third gearbox to said second set of cutting heads to rotate said second set of cutting heads in a second direction.

6. The multi-head cutting tool of claim 4, further comprising self-leveling devices mounted on each of said drum housings.

7. The multi-head cutting tool of claim 4, wherein each cutting head is approximately 22 inches in diameter and approximately 16 inches wide, and wherein a center of said first drum housing is spaced tow feet from a center of said second drum housing.

8. A method for cutting depressions in a road surface, comprising the steps of:

(A) providing a cutting tool comprising first, second, third, and fourth housings, with the first, second and third, and fourth housings, with the first housing being rigidly connected to said second housing to form a first set of cutting heads and said third housing being rigidly connected to said fourth housing to form a second set of cutting heads;

(B) positioning said cutting tool above said surface, wherein said cutting tool has at least two cutting heads which are arranged in parallel with one another and which are connected to one another; then (C) independently aligning each of said first and second cutting head set to compensate for inconsistencies in said surface;

(D) lowering said cutting heads onto said surface; then (E) rotating said cutting heads to cut said depressions in said surface; then (F) raising said cutting heads; then (G) moving said cutting tool ahead and positioning said first cutting head between depressions formed between said first and second butting heads; and then (H) repeating said steps (C) through (F).

9. The method of claim 8, wherein said step (E) comprises the step of rotating said first and second cutting heads in a direction which is opposite to the direction of rotation of said third and fourth cutting heads.

10. The method of claim 9, wherein said step (E) further comprises the step of rotating each of said cutting heads via a common drive device.

11. The method of claim 8, wherein said step (D) comprises the step of swiveling each of said first and second sets of cutting heads in four directions, whereby said cutting tool can be self-aligned with inconsistencies in said surface of said road.

12. A method for cutting depressions in a road surface, comprising the steps of: pg,17

(A) positioning a cutting tool above said surface, said cutting tool comprising at least two cutting heads which are arranged in parallel with one another and which are connected to one another; then (B) lowering said cutting heads onto said surface; then (C) rotating said cutting heads to cut said depressions in said surface; then (D) raising said cutting heads; then (E) moving said cutting tool ahead and positioning said first cutting head between depressions formed between first and second cutting heads; and then (F) repeating said steps (B) through (D).

13. The method of claim 12, wherein said step (C) comprises the step of rotating first and second ones of said cutting heads in opposite directions.

* * * * *

UNITED STATES PATENT AND TRADEMARK OFFICE

CERTIFICATE OF CORRECTION

PATENT NO. : 5,094,565

DATED : March 10, 1992

INVENTOR(S) : Henry Matt JOHNSON

It is certified that error appears in the above-identified patent and that said Letters Patent is hereby corrected as shown below:

Column 5, line 53, Claim 7, "tow" should read --two--.

Column 6, line 2, Claim 8, "housings, with the" should read --cutting heads disposed in respective--.

Column 6, line 14, Claim 8, "set" should read --sets--.

Column 6, line 23, Claim 8, "butting" should read --cutting--.

Column 6, line 39, Claim 12, after --of:-- delete "pg,17".

Signed and Sealed this

Twelfth Day of October, 1993

Bruce Lehman

*Attest:*

BRUCE LEHMAN

*Attesting Officer*

*Commissioner of Patents and Trademarks*